United States Patent [19]

Skahill

[11] 3,941,029

[45] Mar. 2, 1976

[54] PRESSURE RELIEF VALVE FOR PROVIDING RECOIL TO BLANK-FIRING WEAPONS

[75] Inventor: Fred J. Skahill, Davenport, Iowa

[73] Assignee: The United States of America as represented by the Secretary of the Army, Washington, D.C.

[22] Filed: Dec. 17, 1974

[21] Appl. No.: 533,564

[52] U.S. Cl. ..... 89/14 E

[51] Int. Cl.[2] ..... F41F 17/12

[58] Field of Search ..... 89/14 R, 14 E

[56] References Cited

UNITED STATES PATENTS 3,363,509 1/1968 Tschoepe ..... 89/14 E

FOREIGN PATENTS OR APPLICATIONS 137,390 4/1934 Austria ..... 89/14 E

*Primary Examiner*—Stephen C. Bentley

*Attorney, Agent, or Firm*—Nathan Edelberg; Robert P. Gibson; Kalmam Pollen

[57] ABSTRACT

Gas pressure generated during firing of a blank cartridge expands down the bore of a weapon barrel having a pressure relief valve attached to the end thereof and into which the propellant gases are vented to provide barrel recoil and yet prevent residue buildup therein.

4 Claims, 4 Drawing Figures

PRESSURE RELIEF VALVE FOR PROVIDING RECOIL TO BLANK-FIRING WEAPONS

This invention described herein may be manufactured, used and licensed by or for the Government for governmental purposes without the payment to me of any royalty thereon.

This invention relates to weapons and more particularly concerns a pressure relief valve for attachment to barrels of blank firing weapons to provide recoil thereto.

Blank ammunition is used extensively in troop training manuevers. In the past, the barrel for firing blanks was often equipped at its muzzle end with a blank firing attachment which attached to a rigid barrel jacket. The blank firing attachment comprised a containing member having a small aperture facing the open end of the muzzle. Because the aperture easily became fouled or clogged, and because the containing member tended to trap unburnt propellant residues, this blank firing attachment proved generally unsatisfactory.

It is thus an object of this invention to provide a weapon barrel which will recoil and yet not readily foul, clog, or corrode upon repeated firings of blank ammunition therein because of my improved pressure relief valve for use therewith.

These and other objects will be readily apparent from the following description which will be better understood by reference to the accompanying drawings wherein.

Figure 1:
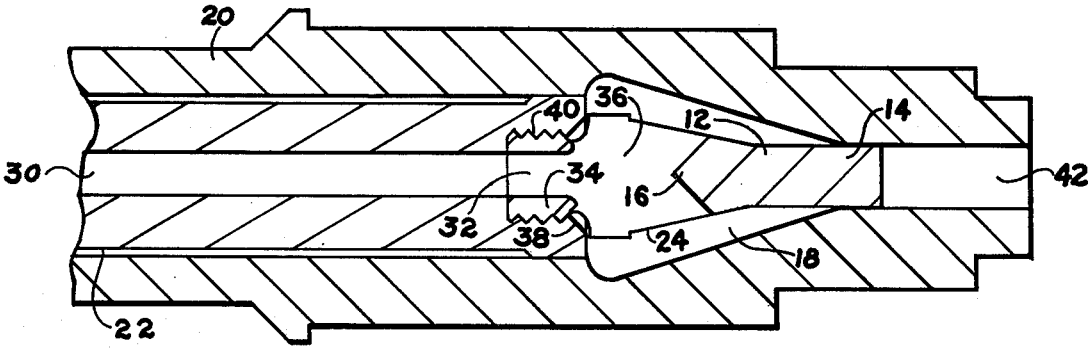
FIG. 1 is a cross-sectional view of a weapon barrel and an embodiment of my pressure relief valve attached thereto.
Figure 2:
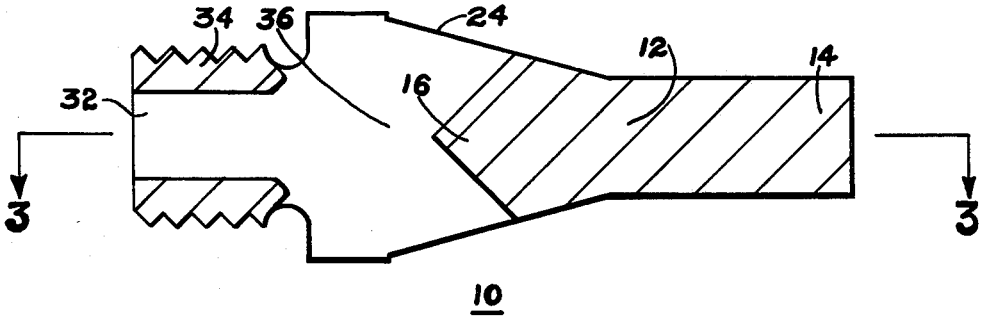
FIG. 2 is a blown-up cross-sectional view of my pressure relief valve shown in FIG. 1.
Figure 3:
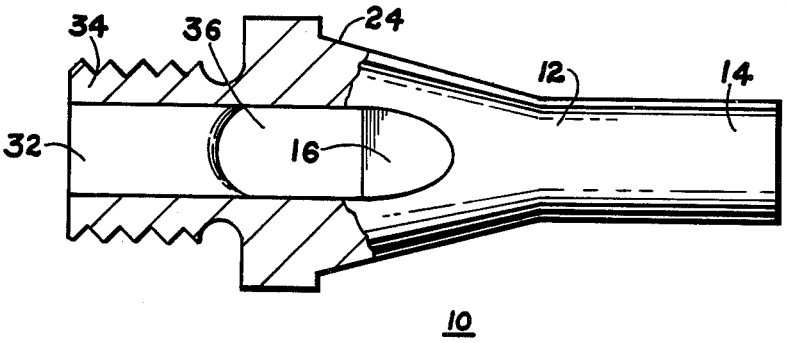
FIG. 3 is a sectional view of my pressure relief valve looking in the direction 3—3 of FIG. 2.
Figure 4:
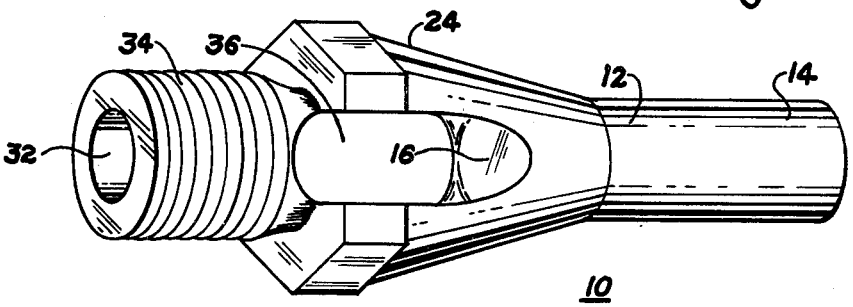
FIG. 4 is perspective view of the pressure relief valve of FIG. 1.

Referring now to the drawings and more particularly to FIGS. 1 and 2 thereof, valve 10, preferably of Stellite, a high temperature cobalt-base alloy steel, although not limited thereto, includes a valve tip 12 comprising forward and rearward portion 14 and 16 respectively, the valve tip sealing a gas assist chamber 18 having outer walls formed by a bearing support 20 slidably mounted to barrel 22, the gas assist chamber 18 having inner walls comprising an outer conically shaped portion 24 of valve 10. A suitable bearing support is that utilized in the M219 Machine Gun which further exemplifies all weapon parts that cooperate with my blank firing attachment. Immediately prior to the firing of a blank round, barrel 22 will be fully extended to its forwardmost position due to a stop in receiver (not shown). Upon firing of the blank cartridge in the weapon, gas pressure from the ignited propellant expands down bore 30 of barrel 22 through an axial orifice 32 of nozzle 34 of valve 10 and into slotted passage 36 (FIG. 3) and thence diverged laterally into gas assist chamber 18 by wedge-shaped rearward portion 16 of valve tip 12 where the gas is initially blocked from exiting the barrel by valve tip 12. Simultaneously, the gas pressure also expands through slotted passage 36 rearwardly to exert a force against muzzle 38 of barrel 22. The cross-sectional area across face of muzzle 38 against which the gases exert a backward force is greater than the cross-sectional area at rearward portion 16 of valve tip 12, where the gases exert a forward force, thus resulting in a backward net force on the barrel to provide recoil thereto. Pressure relief valve 10, threadedly mounted at 40 to barrel 22, moves rearwardly therewith to vent the gases through the exhaust port 42. After recoil, driving spring (not shown) in the M219 Machine Gun will urge the barrel to its forwardmost position thereby completing the cycle of operation. Because the entire opening of exhaust port 42 is available to vent the propellant gases, residues from the burnt propellant gases do not build up in the barrel or exhaust port to cause fouling. When my pressure relief valve was used in an M219 Machine Gun, 20,000 rounds of blank ammunition were fired therein without the need of cleaning the barrel and on another occasion another 25,000 blank rounds were fired therein without any malfunctioning whatsoever of the pressure relief valve.

Typically, there is a large variation in the pressures produced by different production lots of blank cartridges of the same caliber due to their varying propellant energies. In previous blank firing attachments it was necessary to continually adjust the diameter of the exhaust port to accomodate these production lot variations. However, when employing my pressure relief valve, no such adjustments are necessary since regardless of the magnitude of the pressure created by the particular blank cartridge the recoil will take place only upon the attainment of a certain threshold pressure whether that pressure is obtained by a blank cartridge of high or low energy. When employing cartridges of comparatively high propellant energies, the recoil will quite obviously take place sooner than when employing blank cartridges of lower propellant energies.

I have discovered that a valve length of 1.775, inches, exclusive of the length of the nozzle 34, is optimal when used with the M219 Machine Gun. With lengths exceeding the above, I have found that the force of recoil becomes excessive due to the valve tip 12 remaining too long in the exhaust port. Conversely, if the length of the valve is below this value, the force of recoil tends to be feeble. The optimum valve length will vary depending upon the particular weapon used.

It is apparent from the foregoing description that my improved pressure relief valve provides both recoil to the blank firing barrel and most advantageous venting of propellant gases therein. The blank firing barrel may readily be provided with a modified cartridge chamber which tapers forwardly to thus prevent inadvertent firing of live ammunition therein.

I claim:

1. In combination with a weapon barrel used for firing blank cartridges, said barrel having a bearing support slidably mounted thereto adjacent its muzzle end, the improvement therewith comprising a pressure relief valve having a nozzle threadedly mounted to the muzzle end of said barrel and interiorly said bearing support, said valve further comprising, a conically shaped portion foward said nozzle, a valve tip forward said conically shaped portion, said valve tip having a forward and rearward portion, a slotted passage disposed within said conically shaped portion of said valve and between said rearward portion of said valve tip and said nozzle and communicating with said nozzle to permit flow of propellant gases from a central orifice in said nozzle to said valve tip, a gas assist chamber surrounding said slotted passage and said conical portion of said valve, said gas assist chamber having an inner wall comprising said conically shaped portion of said valve and an outer wall comprising a conical surface disposed within said bearing support, said bearing support conical surface being similarly configured as the valve conical surface and spaced therefrom, an exhaust port forward said valve tip, said gas assist chamber being sealed at a forward portion by said valve tip to prevent gases from escaping through said exhaust port, said gas assist chamber communicating with said muzzle and said valve tip, the cross-sectional area across face of said muzzle at which gas exerts a backward force when a blank round is fired being greater than the cross-sectional area of said rearward portion of said valve tip at which gas exerts a foward force to thus provide recoil to said barrel when propellant gases flow through said barrel bore and nozzle and into said pressure relief valve, said recoil providing unsealing of said valve tip from said gas assist chamber and thus allowing propellant gas venting through said exhaust port.

2. A barrel for firing blanks according to claim 1, wherein said pressure relief valve is composed of Stellite.

3. A barrel for firing blanks according to claim 1, wherein said rearward portion of said valve tip of said pressure relief valve is wedge-shaped.

4. A barrel for firing blanks according to claim 1, wherein the length of said valve, exclusive of the length of said nozzle is about 1.775 when used with an M219 Machine Gun.

* * * * *